US007234923B2

(12) United States Patent
Sato

(10) Patent No.: US 7,234,923 B2
(45) Date of Patent: Jun. 26, 2007

(54) SCROLL FLUID MACHINE HAVING A DUST SEAL FITTED WITHIN ANNULAR GROOVE AND HAVING ENDS OVERLAPPED IN THE WIDER PORTION OF THE ANNULAR GROOVE

(75) Inventor: Toru Sato, Yokohama (JP)

(73) Assignee: Anest Iwata Corporation (JP)

( * ) Notice: Subject to any disclaimer, the term of this patent is extended or adjusted under 35 U.S.C. 154(b) by 24 days.

(21) Appl. No.: 11/092,320

(22) Filed: Mar. 29, 2005

(65) Prior Publication Data

US 2005/0232799 A1 Oct. 20, 2005

(30) Foreign Application Priority Data

Apr. 19, 2004 (JP) ..... 2004-122701

(51) Int. Cl.
*F04C 18/02* (2006.01)

(52) U.S. Cl. ..... 418/55.4; 418/55.1; 418/55.3; 418/142; 277/352; 277/564

(58) Field of Classification Search ..... 418/55.1–55.6, 418/57, 142; 277/352, 564, 573, 577, 626
See application file for complete search history.

(56) References Cited

U.S. PATENT DOCUMENTS 5,823,756 A * 10/1998 Kawazoe ..... 418/55.4
6,179,590 B1 * 1/2001 Honma et al. ..... 418/55.4
6,213,742 B1 * 4/2001 Goto et al. ..... 418/55.2
6,592,345 B2 * 7/2003 Suefuji et al. ..... 418/55.4
6,695,597 B2 2/2004 Kimura et al.

FOREIGN PATENT DOCUMENTS

JP 07208353 A * 8/1995
JP 11062858 A * 3/1999
JP 2001336487 A * 12/2001

* cited by examiner

*Primary Examiner*—Theresa Trieu

(57) ABSTRACT

In a scroll fluid machine, an orbiting scroll engages with a stationary scroll to form a sealed chamber in which fluid can be compressed toward a center with revolution of the orbiting scroll with respect to the stationary scroll. An annular groove is formed near the outer circumference of the stationary scroll. A dust seal fits in the annular groove of the stationary scroll. The annular groove has almost the same width, but has a wider portion having the twice the width as the other. In the wider portion of the annular groove, the ends of the dust seal are overlapped. The overlapped surfaces are rough to engage with each other.

14 Claims, 5 Drawing Sheets

SCROLL FLUID MACHINE HAVING A DUST SEAL FITTED WITHIN ANNULAR GROOVE AND HAVING ENDS OVERLAPPED IN THE WIDER PORTION OF THE ANNULAR GROOVE

BACKGROUND OF THE INVENTION

The present invention relates to a scroll fluid machine such as a scroll compressor, a scroll vacuum pump, a scroll expander or a scroll blower.

Such a scroll fluid machine comprises an orbiting scroll supported on an eccentric shaft portion of a drive shaft to turn, and a stationary wrap comprising a stationary end plate having a stationary wrap. An orbiting wrap on an orbiting end plate of the orbiting scroll engages with the stationary wrap to form a sealed chamber between the stationary and orbiting wraps. The scroll fluid machine has a self-rotation preventing device for preventing the orbiting scroll from rotating on its own axis.

By the eccentric shaft portion of the drive shaft and the self-rotation preventing device, the orbiting scroll is eccentrically revolved so that the volume in the sealed chamber gradually decreases toward the center for compression or increases away from the center for depressurizing to discharge from the outer circumference.

The ends of the orbiting and stationary wraps have engagement grooves in which tip seals fit in sliding contact with the opposing end plates sealingly.

In the scroll fluid machine, U.S. Pat. No. 6,695,597 discloses a dust seal on the outer circumference of engagement area of orbiting and stationary wraps. The dust seal comprises a circle; a partially-separated circle the ends of which are contacted or made close; a partially-separated circle the ends of which are engaged with an outer side face of an outermost tip seal; the same as part of a tip seal; and a seal member on the outermost wrap contacting the other sliding surface, as known from the US Patent and other references.

However there are disadvantages in the dust seal of the known scroll fluid machine as below.

(a) circle

The circular dust seal fitted in an annular groove requires quite high accuracy in size and a lot of works and technique. Furthermore, heat and sideward pressure generated with operation stretches or the annular groove is deformed to cause unsuitable fitting. Deviation of the dust seal in the annular groove causes failure in sealing.

(b) partially separated circle the ends of which contacts or become close

To absorb thermal expansion of the dust seal, a little gap has to be formed between the ends in advance. But it is impossible to prevent dust from coming in through the gap completely. To prevent this, the ends of the dust seal are tilted or overlapped, but such working is troublesome to increase cost. The dust seal is likely to move in the annular groove circumferentially.

(c) partially separated circle the ends of which contacts the outer side surface of the outermost tip seal The annular groove must be formed noncircular, which is not so easy for working. During operation, a gap is formed between the end of the dust seal and the outer side surface of the tip seal, so that dust is introduced through the gap.

(d) partially the same as the tip seal

The annular groove must communicate with an engagement groove for the tip seal, which requires a lot of work and technique to increase cost. The dust seal is integrally formed with the tip seal or the end is partially contacted with the outer side surface of the tip seal, which causes the disadvantages as above.

(e) A seal member of the outermost wrap on the opposite sliding surface

A groove in which the seal member engages becomes complicate in shape to make working troublesome and increase cost. The tip seal wears to cause failure in dust sealing.

SUMMARY OF THE INVENTION

In view of the disadvantages in the prior art, it is an object of the invention to provide a scroll fluid machine in which a dust seal is fitted in an annular groove by merely overlapping the ends of the dust seal without special machining of the dust seal.

BRIEF DESCRIPTION OF THE DRAWINGS

The features and advantages of the invention will become more apparent from the following description with respect to embodiments as shown in appended drawings wherein.

DETAILED DESCRIPTION OF PREFERRED EMBODIMENT

Figure 1:
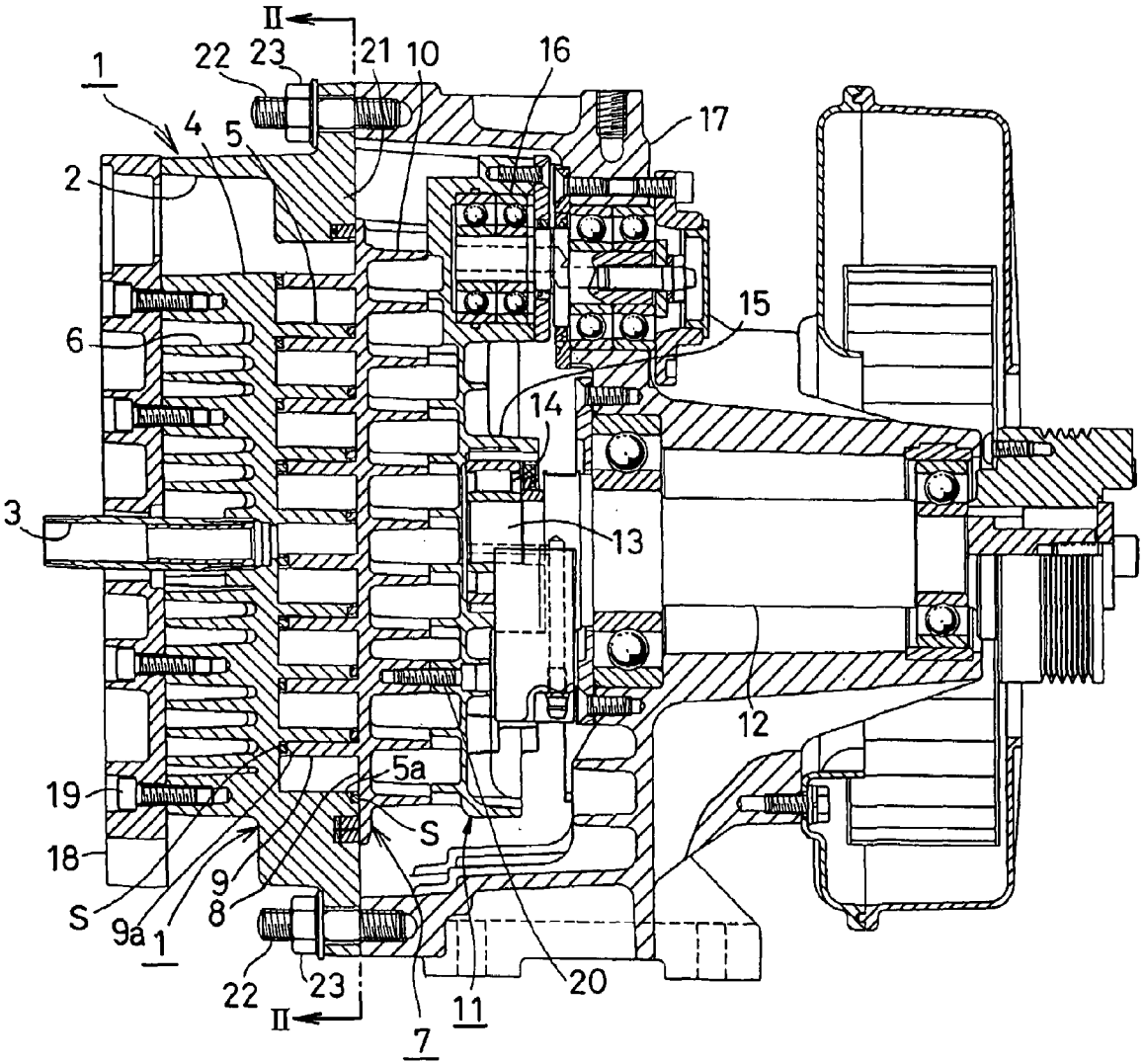
FIG. 1 is a vertical sectional side view of a scroll fluid machine according to the present invention.

FIG. 1 shows a scroll compressor according to the present invention. The present invention may be applied to a scroll fluid machine such as a scroll expander as well.

The scroll compressor in FIG. 1 is known and will be described simply. The left and right sides are front and rear respectively in FIG. 1.

A stationary scroll 1 at the front or left side of FIG. 1 comprises a circular stationary end plate 4 having an inlet 2 at the outer circumference and an outlet 3 at the center. A spiral stationary wrap 5 is provided on the rear surface of the stationary end plate 4 and a plurality of corrugate cooling fins 6 are provided at regular intervals on the front surface.

An orbiting scroll 7 behind the stationary scroll 1 comprises an orbiting end plate 8 which has a spiral orbiting wrap 9 on the front surface facing the stationary scroll 1 and a plurality of corrugated cooling fins 10 at regular intervals on the rear surface.

Behind the orbiting scroll 7, a bearing plate 11 is disposed. At the center of the rear surface of the orbiting scroll 7, there is a tubular boss 15 which supports an eccentric shaft portion 13 of a drive shaft 12 which rotates therein. At three points of the outer circumference of the orbiting scroll 7, there is a known crank-pin-type self-rotation preventing device 16 so that the orbiting scroll 7 eccentrically revolves around the drive shaft 12 with respect to the stationary scroll 1 fixed to a housing 17 in which the orbiting scroll 7 is contained.

A cover plate 18 is provided on the front surface of the stationary scroll 1 and fixed by a screw 19. The orbiting scroll 7 is fixed to the bearing plate 11 by a screw 20. A portion 21 of the stationary scroll 1 is put on the front surface of the housing 17 and fixed by a bolt 22 and a nut 23.

At the end of the stationary wrap 5 and the orbiting wrap 9, there are formed grooves 5*a* and 9*a* in which tip seals "S" fits in sliding contact with the orbiting end plate 8 of the orbiting scroll 7 and the stationary end plate 4 of the stationary scroll 1.

Figure 2:
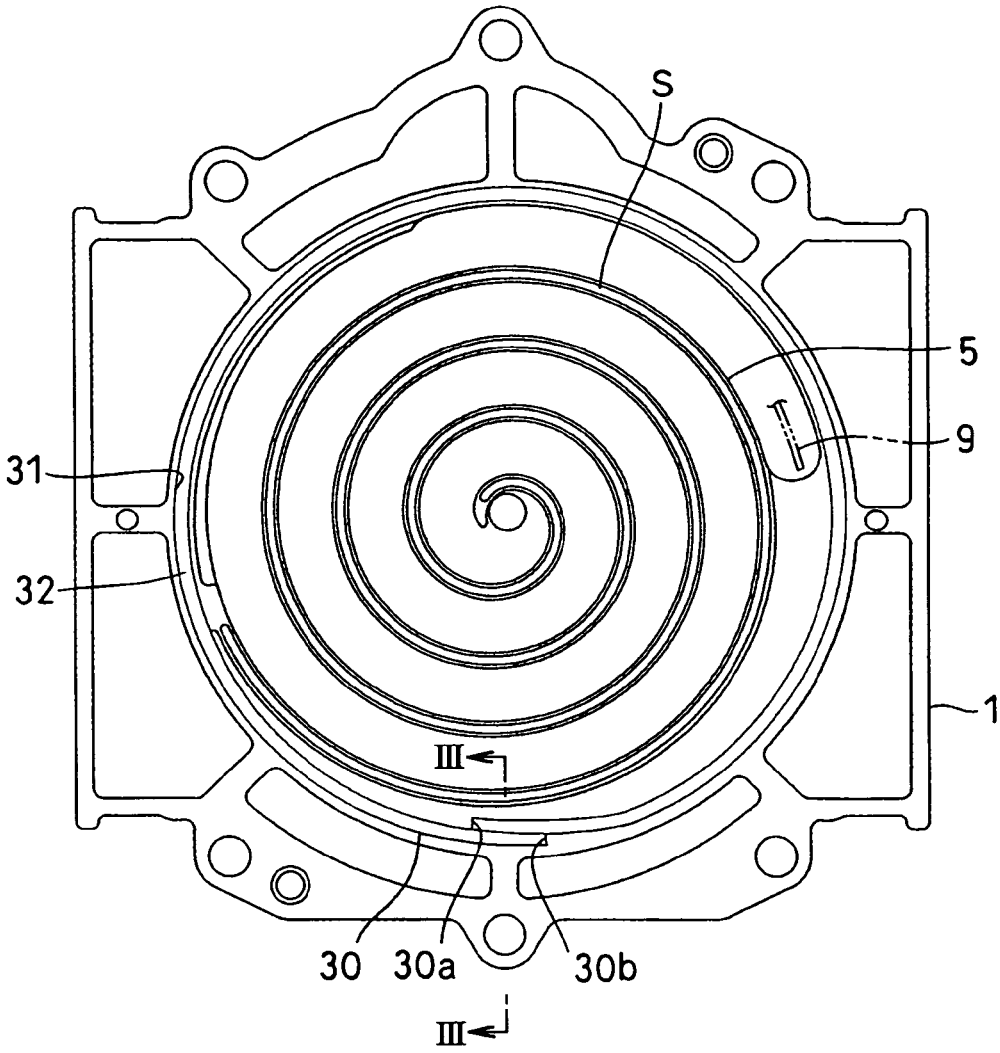
FIG. 2 is a front view seen from the line II—II in FIG. 1.

FIG. 2 shows a portion 21 of the stationary scroll 1 seen from the rear. An annular groove 31 is formed on the outer circumference of the portion 21 of the stationary scroll 1 to surround the stationary wrap 5. The annular groove 31 has almost the same width but a wider portion 30 that is twice the width of the other partially.

A dust seal 32 fits in the annular groove 31. The ends of the dust seal 32 are overlapped in the wider portion 30 and contact or become close to the circumferential end faces 30*a*,30*b* of the wider portion 30.

Figure 3:
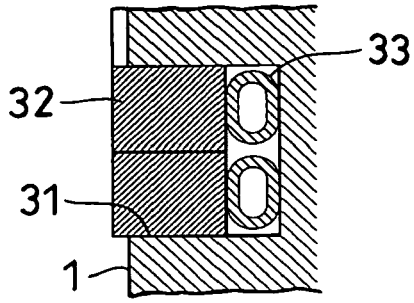
FIG. 3 is an enlarged vertical sectional view taken along the line III—III in FIG. 2.

As shown in FIG. 3, on the bottom of an annular groove 31, a backup tube 33 is fitted to apply elastic force to the dust seal 32.

Figure 4:
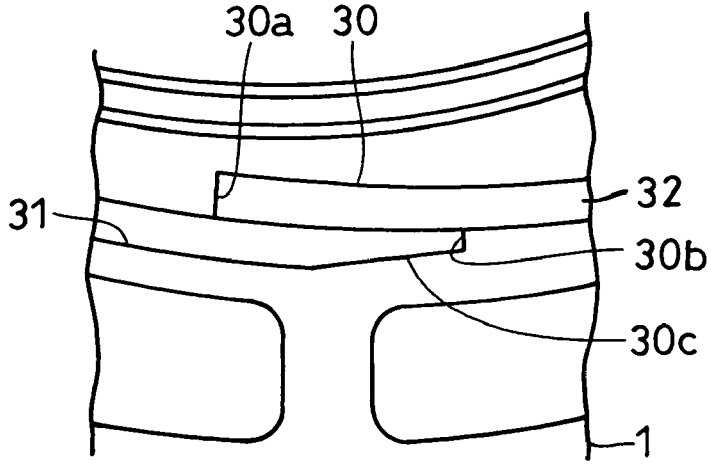
FIG. 4 is an enlarged front view of part of FIG. 2 to show another embodiment of a wider portion of an annular groove and an overlapping portion of a dust seal.
Figure 5:
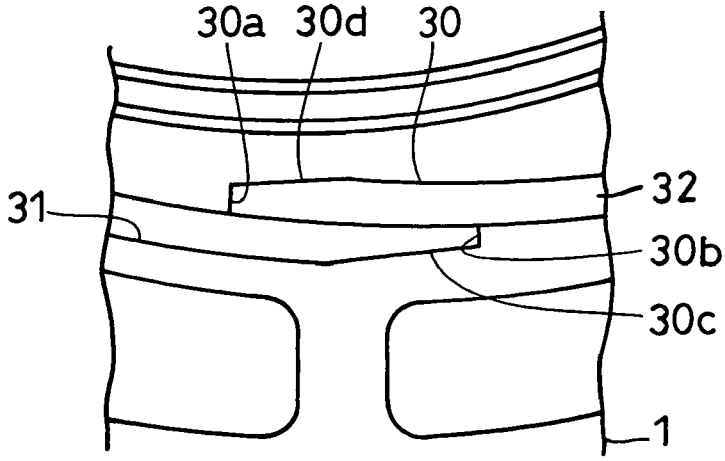
FIG. 5 is similar to FIG. 4 and shows further embodiment thereof.

FIGS. 4 and 5 show different shapes of a wider portion 30 of an annular groove 31. In FIG. 4, an outer circumferential surface 30*c* of the wider portion 30 is tilted to become closer toward an inner circumferential surface 30*d*, and in FIG. 5, inner and outer circumferential surfaces 30*c*,30*d* of the wider portion 30 are inclined in approximate parallel with each other.

Figure 6:
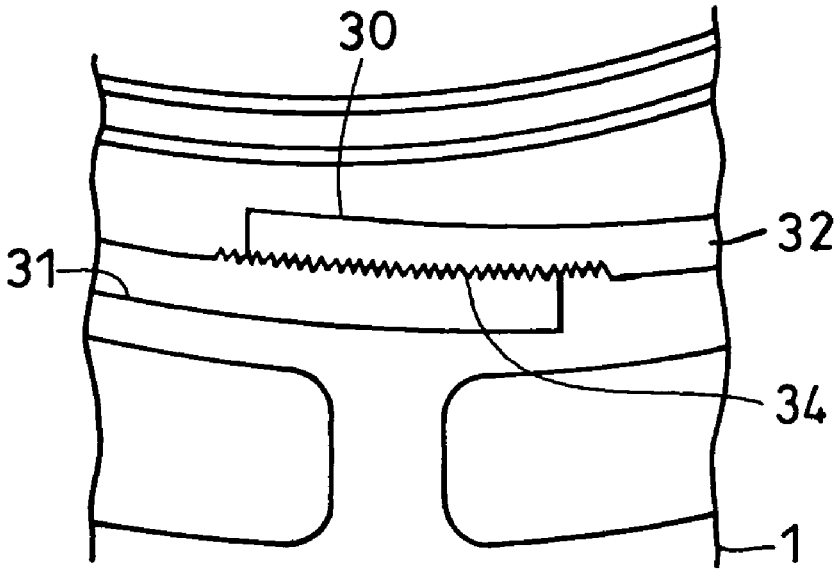
FIG. 6 is similar to FIG. 4 and shows yet another embodiment thereof.

FIG. 6 shows a dust seal 32 which has a plurality of grooves 34 on overlapping surfaces of the ends.

Figure 7:
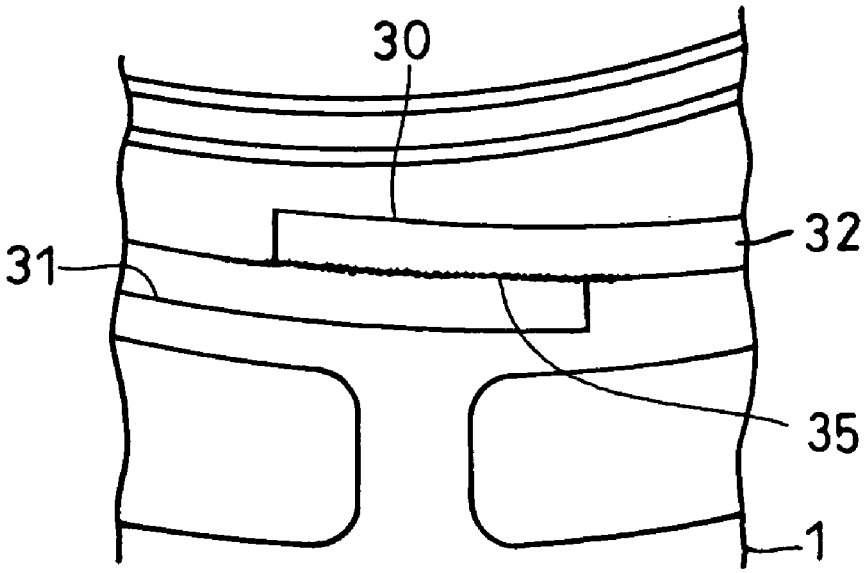
FIG. 7 is similar to FIG. 4 and shows a still further embodiment thereof.
Figure 8:
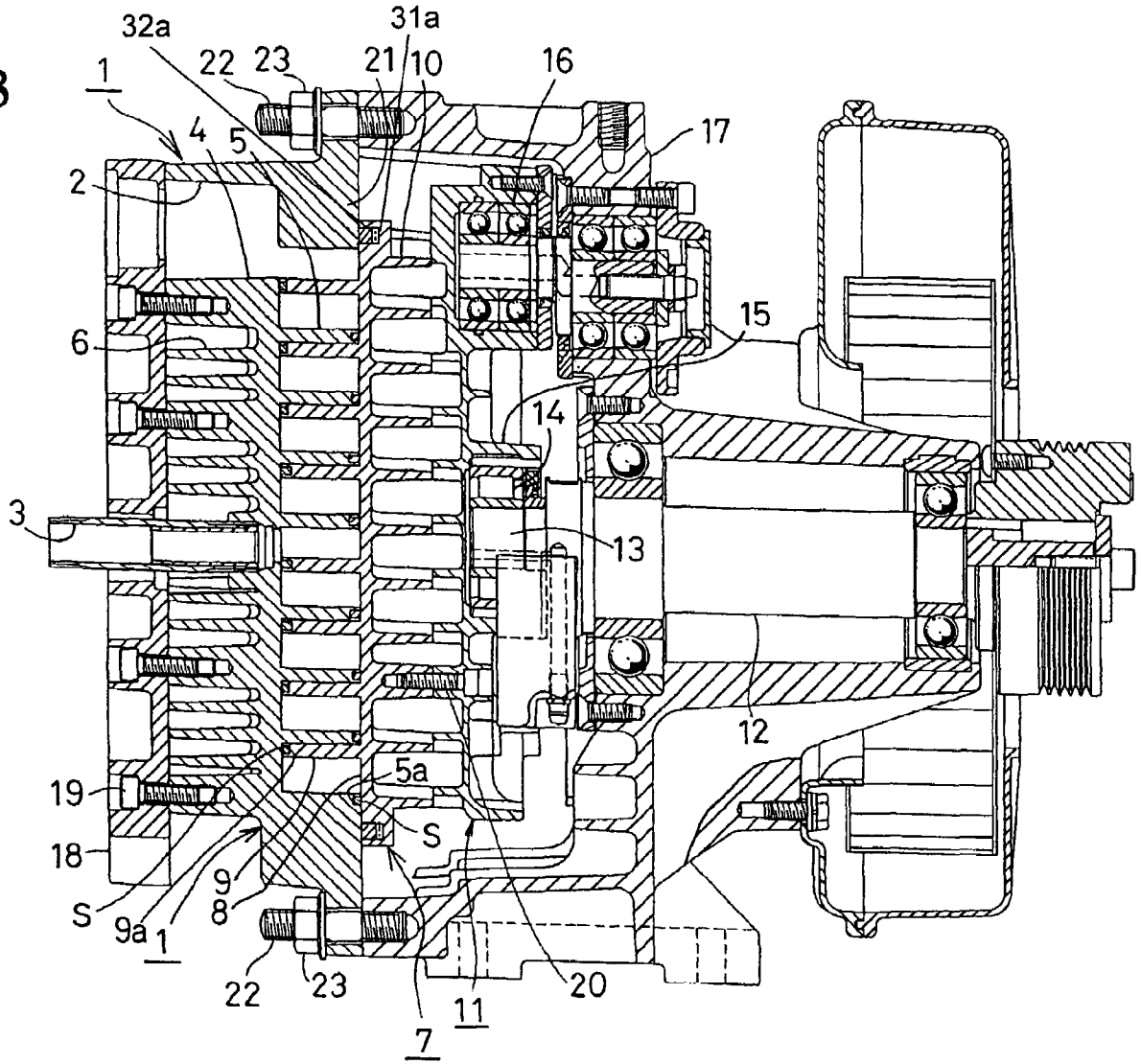
FIG. 8 is shows an embodiment of the present invention, in which the dust seal 32A is put in an annular groove 31A of an orbiting scroll 7.

FIG. 7 shows a dust seal 32 which has rough surfaces 35 on overlapping surfaces of the ends.

The foregoing merely relates to embodiments of the invention. Various changes and modifications may be made by a person skilled in the art without departing from the scope of claims wherein:

What is claimed is:

1. A scroll fluid machine comprising:

a drive shaft having an eccentric shaft portion at one end;

a stationary scroll comprising a stationary end plate having a stationary wrap;

an orbiting scroll comprising an orbiting end plate having an orbiting wrap rotatably mounted around the eccentric shaft portion of the drive shaft so that a sealed chamber may be formed between the stationary wrap and the orbiting wrap;

a self-rotation preventing device for preventing the orbiting scroll from rotating on its axis;

an annular groove formed on the stationary scroll, said annular groove having a wider portion being one part of said annular groove in a circumferential direction and having twice a width of said annular groove, a dust seal engaged in the annular groove and having length which is equal to a circumference and a circumferential length of the wider portion, ends of the dust seal being overlapped in the wider portion of the annular groove, circumferential end faces of the dust seal being contacted with or placed close to end faces of the wider portion of the annular groove.

2. A scroll fluid machine as claimed in claim 1 wherein inner and outer circumferential surfaces of the wider portion of the annular groove are inclined in approximate parallel with each other.

3. A scroll fluid machine as claimed in claim 1 wherein overlapped surfaces of the ends of the dust seal have a plurality of grooves engaged with each other.

4. A scroll fluid machine as claimed in claim 1 wherein overlapped surfaces of the ends of the dust seal are rough to engage with each other.

5. A scroll fluid machine as claimed in claim 1 wherein a backup tube is provided on a bottom of the annular groove to support the dust seal elastically.

6. A scroll fluid machine as claimed in claim 1 wherein one of inner and outer circumferential surfaces of the wider portion of the annular groove is inclined to become closer toward the other circumferential surface.

7. A scroll fluid machine as claimed in claim 6 wherein the outer circumferential surface of the wider portion is inclined to become closer toward the inner circumferential surface.

8. A scroll fluid machine comprising:

a drive shaft having an eccentric shaft portion at one end;

a stationary scroll comprising a stationary end plate having a stationary wrap;

an orbiting scroll comprising an orbiting end plate having an orbiting wrap rotatably mounted around the eccentric shaft portion of the drive shaft so that a sealed chamber may be formed between the stationary wrap and the orbiting wrap;

a self-rotation preventing device for preventing the orbiting scroll from rotating on its axis;

an annular groove formed on the orbiting scroll, said annular groove having a wider portion being one part of said annular groove in a circumferential direction and having twice a width of said annular groove,; and a dust seal engaged in the annular groove and having length which is equal to a circumference and a circumferential length of the wider portion, ends of the dust seal being overlapped in the wider portion of the annular groove, circumferential end faces of the dust seal being contacted with or placed close to end faces of the wider portion of the annular groove.

9. A scroll fluid machine as claimed in claim 8 wherein inner and outer circumferential surfaces of the wider portion of the annular groove is inclined to become closer toward the other circumferential surface.

10. A scroll fluid machine as claimed in claim 9 wherein the outer circumferential surface of the wider portion is inclined to become closer toward the inner circumferential surface.

11. A scroll fluid machine as claimed in claim 8 wherein inner and outer circumferential surfaces of the wider portion of the annular groove are inclined in approximate parallel with each other.

12. A scroll fluid machine as claimed in claim 8 wherein overlapped surfaces of the ends of the dust seal have a plurality of grooves engaged with each other.

13. A scroll fluid machine as claimed in claim 8 wherein overlapped surfaces of the ends of the dust seal are rough to engage with each other.

14. A scroll fluid machine as claimed in claim 8 wherein a backup tube is provided on a bottom of the annular groove to support the dust seal elastically.

* * * * *